US009114431B1

(12) United States Patent
Perlas et al.

(10) Patent No.: US 9,114,431 B1
(45) Date of Patent: Aug. 25, 2015

(54) DEVICE FOR FAULTY ITEM REJECTION

(71) Applicant: Western Digital Technologies, Inc., Irvine, CA (US)

(72) Inventors: Joseph A. Perlas, San Jose, CA (US); Dean Albert Tarrant, Gilroy, CA (US)

(73) Assignee: Western Digital Technologies, Inc., Irvine, CA (US)

( * ) Notice: Subject to any disclaimer, the term of this patent is extended or adjusted under 35 U.S.C. 154(b) by 319 days.

(21) Appl. No.: 13/773,509

(22) Filed: Feb. 21, 2013

(51) Int. Cl.
*B07C 5/00* (2006.01)
*G07C 3/14* (2006.01)

(52) U.S. Cl.
CPC ... *B07C 5/00* (2013.01); *G07C 3/14* (2013.01); *B07C 2501/0009* (2013.01); *B07C 2501/0063* (2013.01); *Y10T 29/49764* (2015.01); *Y10T 29/5303* (2015.01); *Y10T 29/53022* (2015.01); *Y10T 29/53043* (2015.01); *Y10T 29/53048* (2015.01)

(58) Field of Classification Search
CPC .... B07C 2501/0009; B07C 5/00; B07C 5/34; B07C 5/342; B07C 5/3422; B07C 2501/0063; B07C 5/363; B07C 5/365; B07C 5/367; B07C 5/368; B07C 5/38; B07B 13/07; G07C 3/14; Y10T 29/53043; Y10T 29/49764; Y10T 29/53022; Y10T 29/5303; Y10T 29/53048; Y10T 29/53052
See application file for complete search history.

(56) References Cited

U.S. PATENT DOCUMENTS

| | | | | |
|---|---|---|---|---|
| 3,656,615 | A * | 4/1972 | Ptacek | 209/534 |
| 3,841,687 | A * | 10/1974 | Banyas et al. | 294/186 |
| 4,379,510 | A * | 4/1983 | Ziegel | 209/643 |
| 4,951,825 | A * | 8/1990 | Hawkins et al. | 209/558 |
| 5,768,768 | A * | 6/1998 | Best | 29/792 |
| 7,207,430 | B2 * | 4/2007 | Davis et al. | 198/468.4 |
| 7,669,385 | B2 * | 3/2010 | Sichera et al. | 53/53 |
| 7,998,669 | B2 * | 8/2011 | Deppermann et al. | 435/6.1 |
| 8,539,713 | B2 * | 9/2013 | Deppermann et al. | 47/58.1 SE |
| 2008/0000815 | A1 * | 1/2008 | Deppermann | 209/552 |

* cited by examiner

*Primary Examiner* — Sarang Afzali

(57) ABSTRACT

A device may comprise a gripper defining a plurality of openings, each being configured to selectively receive, retain and release an item using a vacuum. One or more sensors may be associated with the plurality of openings, and may be configured to detect a faulty item received in the opening associated therewith. An item receiving structure may be configured to receive items released by the gripper when one or more of the sensors detects that one or more of the received items is faulty. An item receptacle may be configured to receive a plurality of items, and a vacuum chute may be configured to convey items received in the item receiving structure away from the gripper and into the item receptacle under a vacuum force.

9 Claims, 5 Drawing Sheets

DEVICE FOR FAULTY ITEM REJECTION

BACKGROUND

Many complex devices require the handling of very small components during manufacture or assembly. For example, very small screws or other fasteners are often used to secure items to one another. However, the tolerances on the threads or other features of such small fasteners are such that there is a non-trivial number of such fasteners that are faulty or are contaminated with particulates or other unintended impurities. The use of such faulty fasteners can lead to the device under assembly being rejected by quality control and decrease usable yields.

There is a need, therefore, for detecting and rejecting such faulty fasteners before they are put to use. Moreover, such detection and rejection should be carried out in a manner that does not expose the device under assembly or manufacture to contamination through particulates generated by or dislodged from the fastener detection and rejection process. Moreover, such concerns and needs are not limited to fasteners, but extend to many other items used during the manufacture of complex devices.

DETAILED DESCRIPTION

Embodiments are applicable to most any item used during the manufacture of complex assemblies. For exemplary purposes only, however, embodiments are presented herein relative to fungible items such as fasteners (e.g., screws), plugs or ball bearings, to name but a few examples. However, it is to be understood that most any item may be substituted herein for the referenced fasteners.

With particular reference to screws, therefore, automated screw driving tools are often an integral part of automated assembly processes. Any device and method for rejecting faulty (e.g., defective or contaminated) screws must be integrated into such automated screw driving tools and integrated within the assembly workflow without, however, exposing the device being manufactured (hereafter, generically, "workpiece") to particulate contaminants as a result of the item rejection process.

Figure 1:
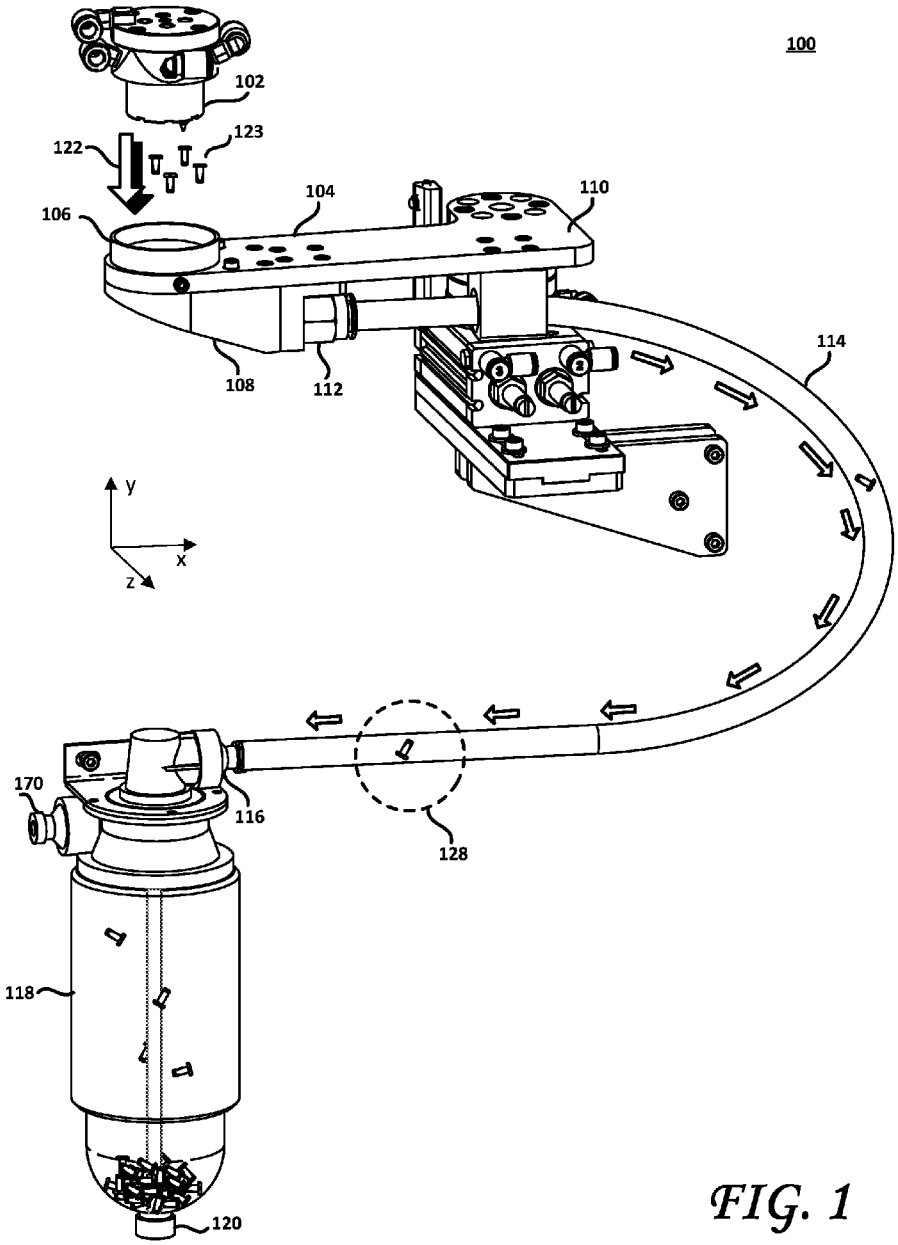
FIG. 1 shows a device according to one embodiment.

FIG. 1 shows a device according to one embodiment. As shown therein, a device 100 according to one embodiment may comprise a gripper 102, such as a vacuum-assisted gripper. The gripper 102 may be configured to define a plurality of openings (best shown in FIGS. 4A and 4B at 404). Each of the openings 404 may be configured to selectively receive, retain and release an item such as a fastener. According to one embodiment, the item may be drawn to, received and retained within the gripper 102 through the force of a vacuum drawn therethrough, although other retaining mechanisms (e.g., mechanical, magnetic, etc.) may be used as well. Also, the items may be released from the openings 404 of the gripper 102 by turning off the vacuum, causing the previously retained items to be released from the openings 404, as shown at 123 in FIG. 1. The device 100 may further comprise one or more sensors (shown at 410 in FIG. 4) configured to detect a faulty item (such as a screw, for example) received in the openings 404 of the gripper 102. According to one embodiment, one sensor 410 may be associated with each of the openings 404 of the gripper 102. For example, the sensors 410 may be disposed within the gripper 102 or may be coupled to vacuum source(s) (shown at 408 in FIG. 4). Alternatively, one sensor may be associated with more than one opening 404. Such sensor(s) 410 may be configured, according to one embodiment, to detect a faulty item (e.g., screw or other fastener) received in the opening 404 associated therewith. For example, the sensor(s) 410 may be configured to measure the forces exerted on the received items by the vacuum drawn through the openings 404. For instance, a baseline force exerted on a non-faulty item received within each opening 404 may be established. Thereafter, by measuring the force exerted on the received item by the vacuum, any deviations from the baseline force above or below a predetermined threshold, non-standard or faulty items may be detected, as the vacuum will exert a different force on faulty items than it will on standard, non-faulty items. Other methods and mechanisms for detecting faulty items may be readily implemented in other embodiments. For example, according to one embodiment, optical sensors may be employed, to measure some optical characteristic (e.g., reflectance, spectra, profile, etc.) of the items received within the openings 404 to detect faulty items.

According to one embodiment, when one or more of the sensors 410 detects that one or more of the items received within the openings 404 of the gripper 102 is faulty, the gripper 102 may be controlled to release at least the faulty item from the opening having received the faulty item. According to one embodiment, when one or more of the sensors 410 detect one or more faulty items (such as one or more faulty screws), all of the items received in all of the openings 404 may be released from the gripper 102, as shown at reference numeral 123 in FIG. 1. As the items are released, they fall, under the influence of gravity, toward an item receiving structure 104, as suggested by arrow 122.

As shown in FIG. 1, the item receiving structure 104, according to one embodiment, may be configured to receive items (e.g., screws or other types of fasteners) released by the gripper 102 through a mouth 106 thereof when one or more of the sensors 410 detects that one or more of the items received in the gripper 102 is faulty. Within the present context, the phrase "faulty item" encompasses within its scope defective items, non-standard items, contaminated items, wrong items, and/or any item that deviates from a desired item. Such faulty items may also be characterized as having been rejected as being unsuitable for inclusion in or attachment to the workpiece under assembly. According to one embodiment, the device 100 is configured to remove such rejected items from the vicinity of the workpiece (which may be disposed below the vacuum assisted gripper 102). However, when the items are released from the gripper 102 as shown at 123, merely collecting them in an open receptacle below the mouth 106 of the item receiving structure 100 has been found to be less than optimal, particularly in clean-room environments. Indeed, there may be severe clearance constraints in the "y" direction, that is, between the gripper 102 and the workpiece. Such clearance constraints limit the size of any receptacle for the released items, which would then necessitate frequent emptying which, in turn, may decrease yield. Moreover, when items such as screws are released from the gripper 102 and fall within an open container, particulates or other contaminants may be knocked off or otherwise released from the items as they impact each other and/or the underlying receptacle. Such particulates may be sufficiently large as to degrade or even destroy the functionality of the underlying workpiece. For example, when the workpiece includes a spindle motor and rotating media of a hard disk drive, such dislodged particles may mar the recording surface of the media and cause a read-write head of the disk drive to crash and fail. It has been found, therefore, that it is preferable to evacuate the items released by the gripper 102 away from the workpiece in a manner that does not generate or spread particulates in and around the workpiece under assembly.

According to one embodiment, therefore, a vacuum chute 114 may be provided. The vacuum chute 114 may define a closed conduit to transport the items (shown at 123) released from the gripper 102 away from the workpiece while reducing or eliminating the spread of particulates or impurities caused by the release of the items from the gripper 102. According to one embodiment, the vacuum chute 114 may be coupled, at one end thereof, to the item receiving structure 104 at an outlet thereof, shown in FIG. 1 at 112. The vacuum chute 114 may also be coupled, at another end thereof, to an item receptacle 118 configured to receive a plurality of items. The vacuum chute 114 may be coupled to the item receptacle 118 at an inlet 116. According to one embodiment, the vacuum chute 114 may be configured to convey items received in the item receiving structure 104 away from the gripper 102 and into the item receptacle 118 at least partially under a force of vacuum. In the embodiment shown in FIG. 1, the vacuum may be drawn from an inlet 170 coupled to or near, for example, the item receptacle 118. In the case in which the item receptacle 118 is disposed lower than, for example, the outlet 112, gravity may also assist in conveying items released from the gripper 102 to the item receptacle 118. According to one embodiment, the vacuum chute 114 may comprise a tube. The tube may, for example, comprise an extruded polymeric material such as, for example, plastic, nylon, polycarbonate, polyethylene, polypropylene and/or polyurethane, to identify but a few possibilities. According to one embodiment, to avoid items becoming stuck within the vacuum tube 114, the inner diameter of the tube may be greater than the greatest dimension of any of the items received in the gripper. This is illustrated at 128 in FIG. 1, in which the inner diameter of the tube of the vacuum chute 114 is greater than a largest dimension of the item being conveyed therein (in the case illustrated in FIG. 1, a screw).

In operation, when the gripper 102 detects or otherwise determines that one or more of the items received therein are faulty, it may be caused to release that item or all items received therein. The released items, as shown at 123 in FIG. 1, may fall into the mouth 106 of the item receiving structure 104 and thereafter may be drawn within the vacuum chute 114, at least partially by the force of vacuum. The items may thereafter be pulled within the vacuum chute 114 toward the item receptacle 118 and may drop therein to be collected at the bottom of item receptacle 118, in the manner illustrated in FIG. 1. As the vacuum chute 114 may be hermetically sealed to the item receiving structure 104 at the outlet 112 and may be hermetically sealed to the item receptacle 118 at the inlet 116 thereof, particulates or impurities generated or present on the items released from the gripper 102 are unlikely to spread to or in the vicinity of the workpiece under assembly. When the item receptacle 118 is full (or whenever desired), it may be removed through, for example, unscrewing central fitting 120 to detach the receptacle from the device 100. The items (e.g., screws or other fasteners) contained therein may be disposed of or reworked, as appropriate. Note that, in the case wherein all received items are released when fewer than all received items are detected to be faulty, the item receptacle 118 may include both faulty and non-faulty items.

In the case in which sufficient vertical clearance is available (i.e., in the "y" direction indicated in FIG. 1), the item receptacle 118 may be disposed below (e.g., directly below, or below and offset in the "x" and/or "z" directions) relative to the mouth 106. In that case, the vacuum chute 114 may be omitted or at least substantially shortened. According to one embodiment, the receptacle 118 may be disposed away from the vacuum chute 114 and/or other structures, such as the item receiving structure 104 and the gripper 102. Disposing the receptacle 118 away from other structures of the device alleviates both size and space constraints, enabling the receptacle 118 to have most any size or shape. Moreover, disposing the receptacle 118 away from other structures may facilitate the emptying thereof in a manner that minimizes the chances of contaminating the item being manufactured or other sensitive structures. Depending upon the configuration, gravity may provide all or a greater part of the force necessary to convey the items released from the gripper 102 to the item receptacle 118. In any event, an area of localized reduced barometric pressure in and around the mouth 106 may be advantageous, so as to draw particulates within the item receiving structure 104 and into the vacuum chute 114, to correspondingly reduce the incidence of particulates or contaminants on or around the workpiece.

As noted above, however, the available vertical clearance may be quite low. Such low available vertical clearance may require that much of the structure of the item receiving structure 104 closest to the gripper 102 extend preferentially in the "x" direction. As such, the items released from the gripper 102 may not have sufficient energy to convey them, through the force of gravity, to or near the outlet 112, particularly if the vacuum is not sufficient to draw the released items to the outlet 112 and into the vacuum chute 114. Therefore, according to one embodiment, the item receiving structure 104 may comprise an inclined surface 108. The inclined surface 108, according to one embodiment, may be that surface with which the items released from the gripper 102 first come into contact upon being released. Such an inclined surface 108, therefore, may be effective in conveying the released items (e.g., fasteners or other items to be attached to the workpiece) toward the vacuum chute 114 at least partially under the force of gravity. That is, when released by the gripper 102, the items may first contact the inclined surface 108 and tumble over and down the inclined surface 108 toward the outlet 112, whereupon they may be drawn within the vacuum chute 114 by the vacuum within the vacuum chute 114. According to one embodiment, the surface 108 may be inclined at an angle within a range of about 10 degrees to about 45 degrees relative to a reference plane, such as a plane parallel to the "x" direction, for example. For example, the inclined surface 108 may define an angle of about 15 degrees, although other angles are possible.

Figure 2:
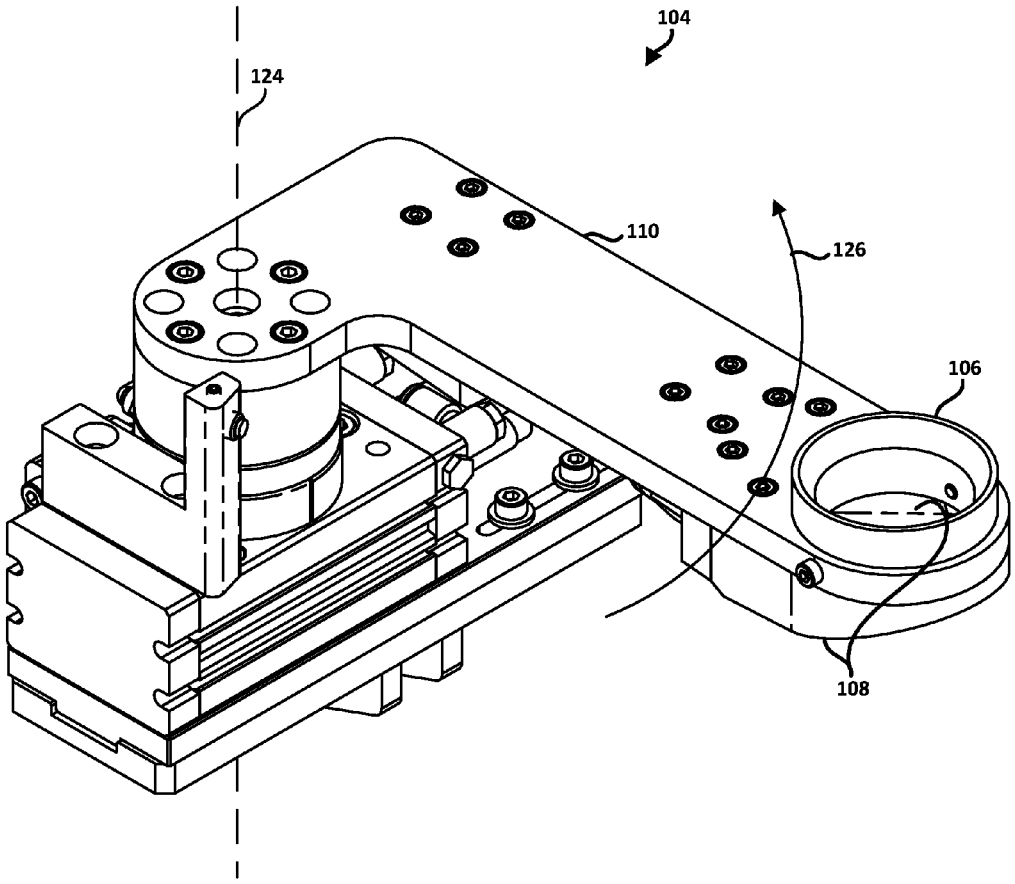
FIG. 2 is a view of item receiving structure of a device according to one embodiment.
Figure 3:
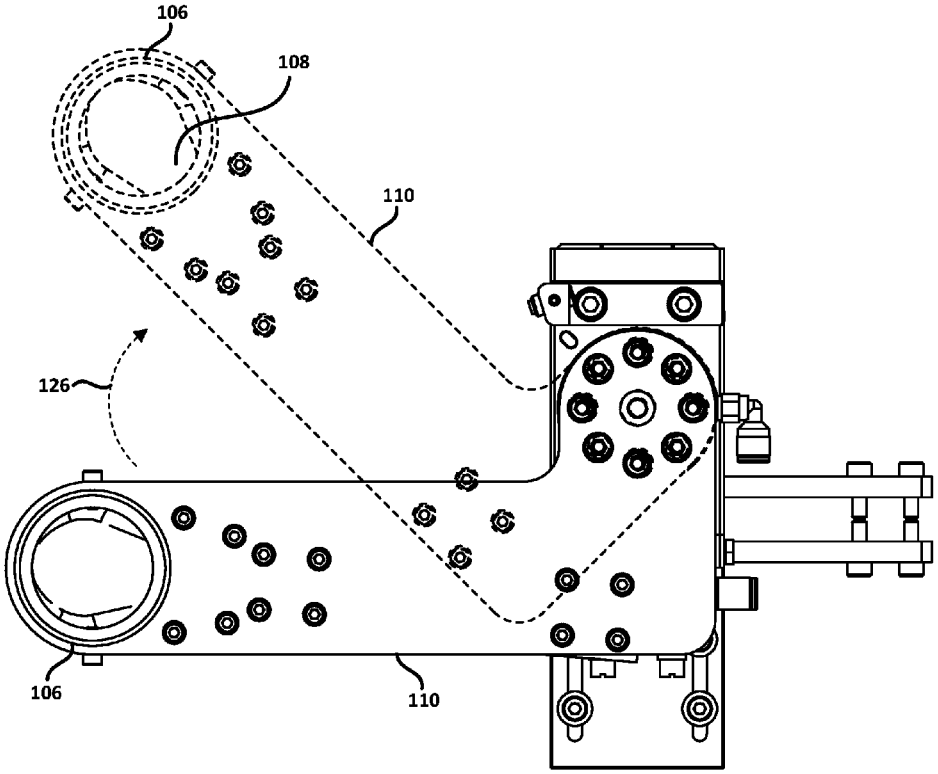
FIG. 3 shows another view of an item receiving structure of a device according to one embodiment.

FIGS. 2 and 3 show a portion of the item receiving structure 104, according to one embodiment. As shown therein, the item receiving structure 104 may comprise a movable arm 110 that is configured to move away from the gripper 102 when none of the plurality of sensors 410 detects a faulty item and that is configured to move to a position (e.g., under or otherwise adjacent the gripper 102) in which the mouth 106 may receive the items released by the gripper 102 when one or more of the sensors 410 detects a faulty item. According to one embodiment, the movable arm may be configured to pivot as shown at 126 about an axis, such as axis 124, between at least a first position under the gripper 102 and a second position away from the gripper 102. It is to be understood that the movable arm 110 may be configured to pivot about another axis and/or may be configured for a rotational and/or a translational movement between first and second positions.

Figure 4A:
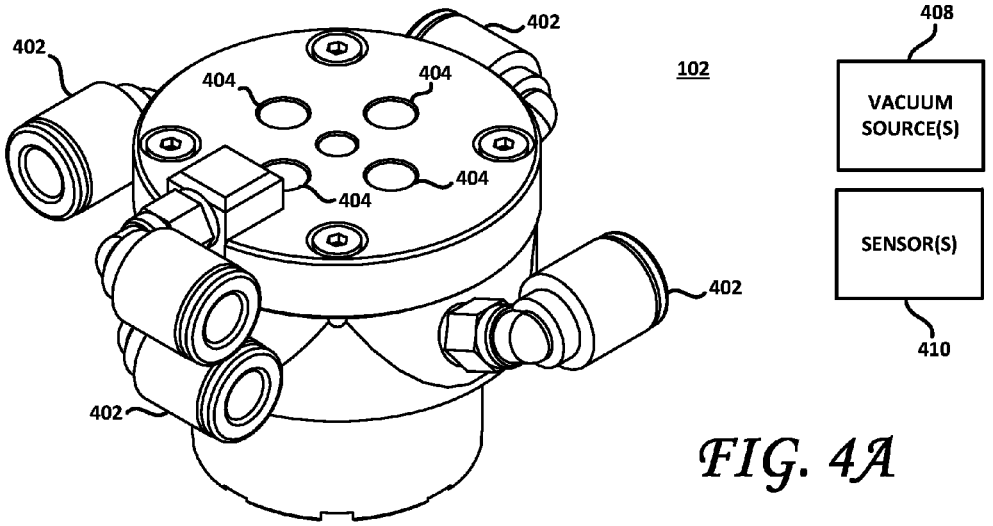
FIG. 4A shows a view of a gripper of a device according to one embodiment.
Figure 4B:
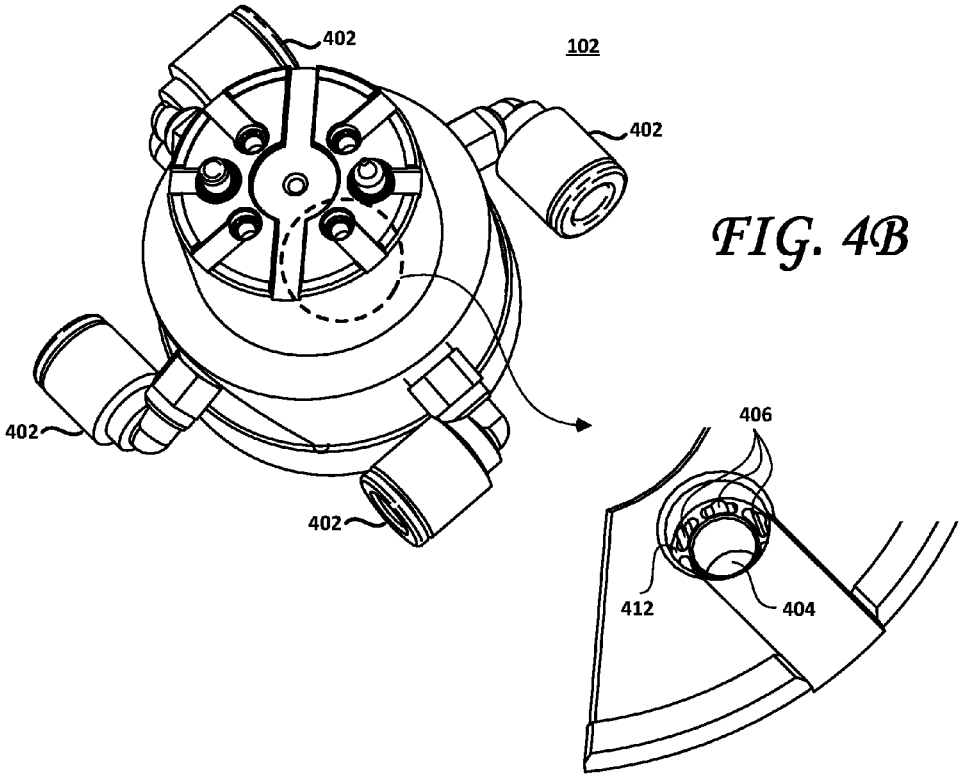
FIG. 4B shows another view of a gripper of a device according to one embodiment.

FIGS. 4A and 4B show two views of a gripper 102 of a device according to one embodiment. FIG. 4A is a view of the gripper 102 in which the top surface (away from the workpiece) is visible, whereas FIG. 4B is a view of the gripper 102 in which the bottom surface (facing the workpiece and the mouth 106 of the item receiving structure 104) is visible. FIG. 4B also includes a detail view of an opening in the gripper 102 in which the items (e.g., fasteners or other structures) may be received, retained and from which such items may be released.

According to one embodiment, the openings 404 defined within the gripper 102 may extend as bores through the vacuum assisted gripper 102, so as to enable free passage therethrough of a mechanism configured to attach or place the retained items to or on a workpiece. Such a mechanism may comprise, for example, a tool. For example, in the embodiment in which the items are screws, the gripper 102 may be configured such that the openings 404 are sized to admit a screwdriver bit therethrough. Therefore, in operation, the gripper 102 may receive and retain a plurality of screws and, if none of the retained screws are detected to be faulty by sensors) 410, screwdriver bits may be inserted through the openings 404, through the length of the gripper 102 and extend to the workpiece, to drive the screws therein, in precise alignment with, for example, corresponding threaded blind bores defined in the workpiece. As shown in the detail view of FIG. 4B, to aid in the retention of the items within the openings 404, a vacuum may be drawn from channels 406 defined within the gripper 102. Such channels 406 may terminate at a ledge 412 within the opening 404. The ledge 412 may be configured to restrict the size of the opening 404 to enable the item to be seated therein, while still enabling a tool such as a screwdriver bit to be inserted. In operation, the vacuum drawn through the channels 406 tends to bias the item in intimate contact with ledge 412, thereby precisely aligning the item in its intended location and orientation. The vacuum may be drawn from vacuum inlets 402, one for each of the openings 404. The vacuum inlets 402 may be coupled to one or more vacuum sources 408.

Figure 5:
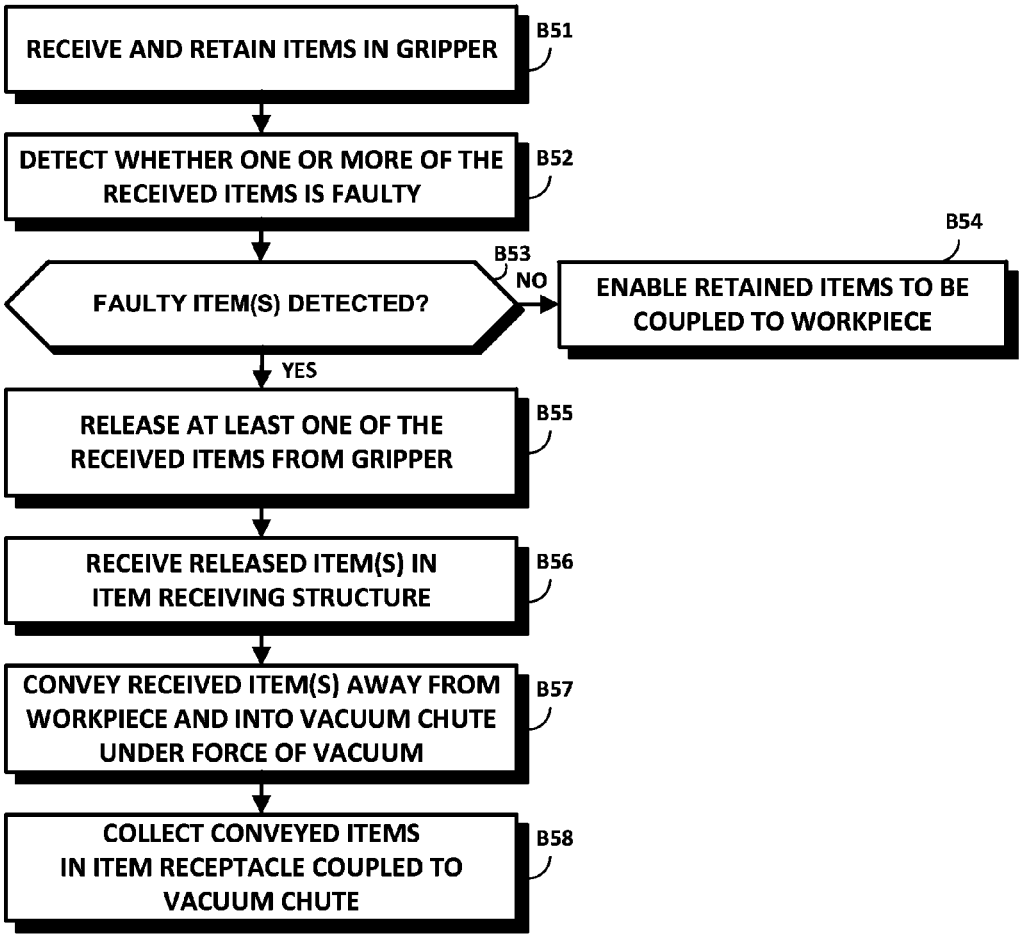
FIG. 5 is a flowchart of a method according to one embodiment.

FIG. 5 is a flowchart of a method according to one embodiment. As shown therein, block B51 calls for receiving and retaining a plurality of items in a gripper. Thereafter, block B52 calls for detecting whether one or more of the received items is faulty and should be rejected. If, in block B53, none of the received items are detected as being faulty (NO branch of B53), the retained items (e.g., fasteners) may be attached, coupled or disposed within or on the workpiece, as appropriate, as shown at block B54. If, however, one or more of the received items is detected to be faulty (YES branch of B53), one or more of the received items may be released from the gripper, as shown at B55. According to one embodiment, all received items may be released from the vacuum assisted gripper 102 upon detection of even one faulty received item. As shown at B56, the released item(s) may then be received in the item receiving structure 104, which is configured to receive items released by the gripper 102. The received items may then be conveyed within the item receiving structure 104 away from the workpiece and into a vacuum chute 114, at least partially under a force of the vacuum, as called for at block B57. Lastly, Block B58 calls for collecting the conveyed items in an item receptacle 118 coupled to the vacuum chute 114.

Advantageously, embodiments allow for increased capacity of faulty item rejection and disposal and minimize yield interruption. Moreover, embodiments are well suited to clean room environments and the maintenance of contamination control requirements. Debris from the faulty item detection and rejection process described and shown herein is contained and isolated from the workpiece under assembly by pulling vacuum in the closed and sealed item receiving structure 104.

While certain embodiments of the disclosure have been described, these embodiments have been presented by way of example only, and are not intended to limit the scope of the disclosure. Indeed, the novel methods, devices and systems described herein may be embodied in a variety of other forms. Furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure. For example, those skilled in the art will appreciate that in various embodiments, the actual structures (such as, for example, the item receiving structure 104) may differ from those shown in the figures. Depending on the embodiment, certain of the steps described in the example above may be removed, others may be added. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

The invention claimed is:

1. A device, comprising:

a gripper defining a plurality of openings, each of the plurality of openings being configured to selectively receive, retain and release an item using a vacuum;

one or more sensors associated with the plurality of openings, configured to detect a faulty item received in the opening associated therewith;

an item receiving structure configured to receive items released by the gripper when at least one of the sensors detects that at least one of the received items is faulty;

an item receptacle configured to receive a plurality of items; and a vacuum chute configured to convey items received in the item receiving structure away from the gripper and into the item receptacle under a vacuum force, wherein the item receiving structure comprises a movable arm configured to move away from the gripper when none of the sensors detects a faulty item and configured to move under the gripper to receive items released by the gripper when at least one of the sensors detects a faulty item, and wherein the item receptacle is disposed away from the gripper and the item receiving structure.

2. The device of claim 1, wherein the item receiving structure comprises an inclined surface with which items first come into contact upon being released by the gripper, the inclined surface being configured to convey items toward the vacuum chute at least partially under a force of gravity.

3. The device of claim 2, wherein the inclined surface is inclined at an angle within a range of about 10 degrees to about 45 degrees relative to a reference plane.

4. The device of claim 1, wherein the vacuum chute comprises a tube.

5. The device of claim 4, wherein an inner diameter of the tube is greater than a greatest dimension of any of the plurality of items received in the gripper.

6. The device of claim 1, further comprising a vacuum supply inlet coupled to the vacuum chute.

7. The device of claim 1, wherein the gripper is configured to release all of the plurality of items retained in the plurality of openings when at least one of the sensors detects a faulty item.

8. The device of claim 1, wherein the device is configured to be coupled to a mechanism configured to attach the plurality of items to a workpiece.

9. The device of claim 1, wherein the one or more sensors comprises a plurality of sensors, each of the plurality of sensors being associated with one of the plurality of openings.

* * * * *